US009278820B2

(12) United States Patent
Yamaguchi et al.

(10) Patent No.: US 9,278,820 B2
(45) Date of Patent: Mar. 8, 2016

(54) SHEET STACKING DEVICE, SHEET CONVEYING DEVICE, AND IMAGE FORMING APPARATUS

(71) Applicant: KYOCERA Document Solutions Inc., Osaka-shi, Osaka (JP)

(72) Inventors: Yoshihiro Yamaguchi, Osaka (JP); Katsuhiro Yoshiuchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/525,042

(22) Filed: Oct. 27, 2014

(65) Prior Publication Data

US 2015/0115523 A1 Apr. 30, 2015

(30) Foreign Application Priority Data

Oct. 30, 2013 (JP) ..... 2013-226026

(51) Int. Cl.
*B65H 1/14* (2006.01)
*B65H 7/02* (2006.01)
*B65H 7/20* (2006.01)

(52) U.S. Cl.
CPC .. *B65H 1/14* (2013.01); *B65H 7/02* (2013.01); *B65H 7/20* (2013.01); *B65H 2403/92* (2013.01); *B65H 2511/52* (2013.01); *B65H 2515/704* (2013.01)

(58) Field of Classification Search
CPC ..... B65H 1/14; B65H 7/20; B65H 7/02
See application file for complete search history.

(56) References Cited

FOREIGN PATENT DOCUMENTS

| | | | | |
|---|---|---|---|---|
| JP | 03046932 | A | * | 2/1991 |
| JP | 07277551 | A | | 10/1995 |
| JP | 08169568 | A | * | 7/1996 |
| JP | 2003137446 | A | * | 5/2003 |

* cited by examiner

*Primary Examiner* — Luis A Gonzalez
(74) *Attorney, Agent, or Firm* — Alleman Hall McCoy Russell & Tuttle LLP

(57) ABSTRACT

A sheet stacking device includes sheet stacking portion, electric motor, current detecting portion, abnormality determining portion, and updating portion. The sheet stacking portion is supported to be movable in up-down direction and configured to stack sheets thereon. The electric motor outputs, to the sheet stacking portion, a driving force for moving the sheet stacking portion in up-down direction. The current detecting portion detects a current value of the electric motor. The abnormality determining portion determines that the sheet stacking portion is in abnormal state when the detected current value is greater than a predetermined threshold. The updating portion updates the threshold based on the current value that was detected by the current detecting portion while the sheet stacking portion with a predetermined set amount of sheets stacked thereon was being moved by the driving force received from the electric motor.

6 Claims, 7 Drawing Sheets

SHEET STACKING DEVICE, SHEET CONVEYING DEVICE, AND IMAGE FORMING APPARATUS

INCORPORATION BY REFERENCE

This application is based upon and claims the benefit of priority from the corresponding Japanese Patent Application No. 2013-226026 filed on Oct. 30, 2013, the entire contents of which are incorporated herein by reference.

BACKGROUND

The present disclosure relates to a sheet stacking device in which a plurality of sheets can be stacked, and to a sheet conveying device and an image forming apparatus that include the sheet stacking device, and in particular, to a sheet stacking device having a function to determine whether or not a sheet stacking portion is in an abnormal state, wherein the sheet stacking portion is supported to be movable in the up-down direction, and to a sheet conveying device and an image forming apparatus including the sheet stacking device.

An image forming apparatus such as a copier includes a sheet stacking portion on which a plurality of print sheets are stacked. The sheet stacking portion is configured to receive a driving force from an electric motor such as a motor and be moved in the up-down direction. In this type of image forming apparatus, when the upper surface of the print sheets is lowered in position due to decrease of the print sheets on the sheet stacking portion, the sheet stacking portion is moved upward until the upper surface is recovered to the position before it was lowered. With this configuration, the upper surface of the print sheets on the sheet stacking portion is always set to a position at which a print sheet can be fed.

As a device that includes the sheet stacking device, there is known a sheet feed device that can detect whether or not an abnormal operation has occurred in the sheet stacking portion, based on the driving current of the electric motor. In this sheet feed device, an overload current value for detecting abnormality in correspondence with the print sheet size is set for each of driving controls for raising and lowering a sheet feed tray (i.e., the sheet stacking portion). When a measured value of the driving current of the electric motor is larger than the overload current value, the sheet feed device detects that the sheet stacking device is in an abnormal operation.

SUMMARY

A sheet stacking device according to an aspect of the present disclosure includes a sheet stacking portion, an electric motor, a current detecting portion, an abnormality determining portion, and an updating portion. The sheet stacking portion is configured to stack a plurality of sheets thereon, wherein the sheet stacking portion is supported to be movable in an up-down direction. The electric motor outputs, to the sheet stacking portion, a driving force for moving the sheet stacking portion in the up-down direction. The current detecting portion detects a current value of the electric motor. The abnormality determining portion determines that the sheet stacking portion is in an abnormal state when the current value detected by the current detecting portion is greater than a predetermined threshold. The updating portion updates the threshold based on the current value that was detected by the current detecting portion while the sheet stacking portion with a predetermined set amount of sheets stacked thereon was being moved by the driving force received from the electric motor.

A sheet conveying device according to another aspect of the present disclosure includes the sheet stacking device and a conveying portion configured to pick up sheets from the sheet stacking device and convey the sheets one by one.

An image forming apparatus according to a further aspect of the present disclosure includes the sheet stacking device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It should be noted that the following description is an example of an embodiment of the present disclosure and the embodiment of the present disclosure can be modified as appropriate within the scope of the present disclosure.

Figure 1:
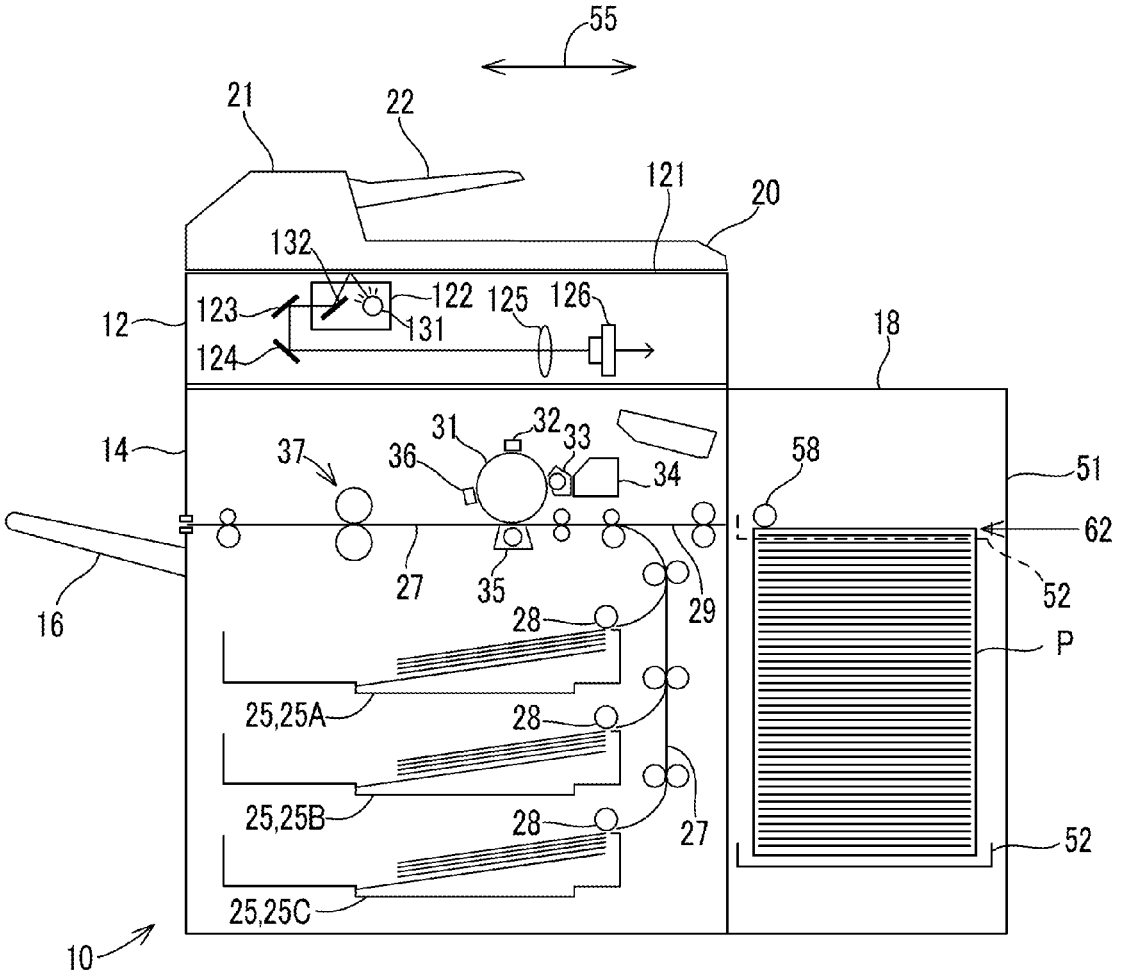
FIG. 1 is a diagram showing the configuration of an image forming apparatus including a sheet feed device according to an embodiment of the present disclosure.
Figure 2:
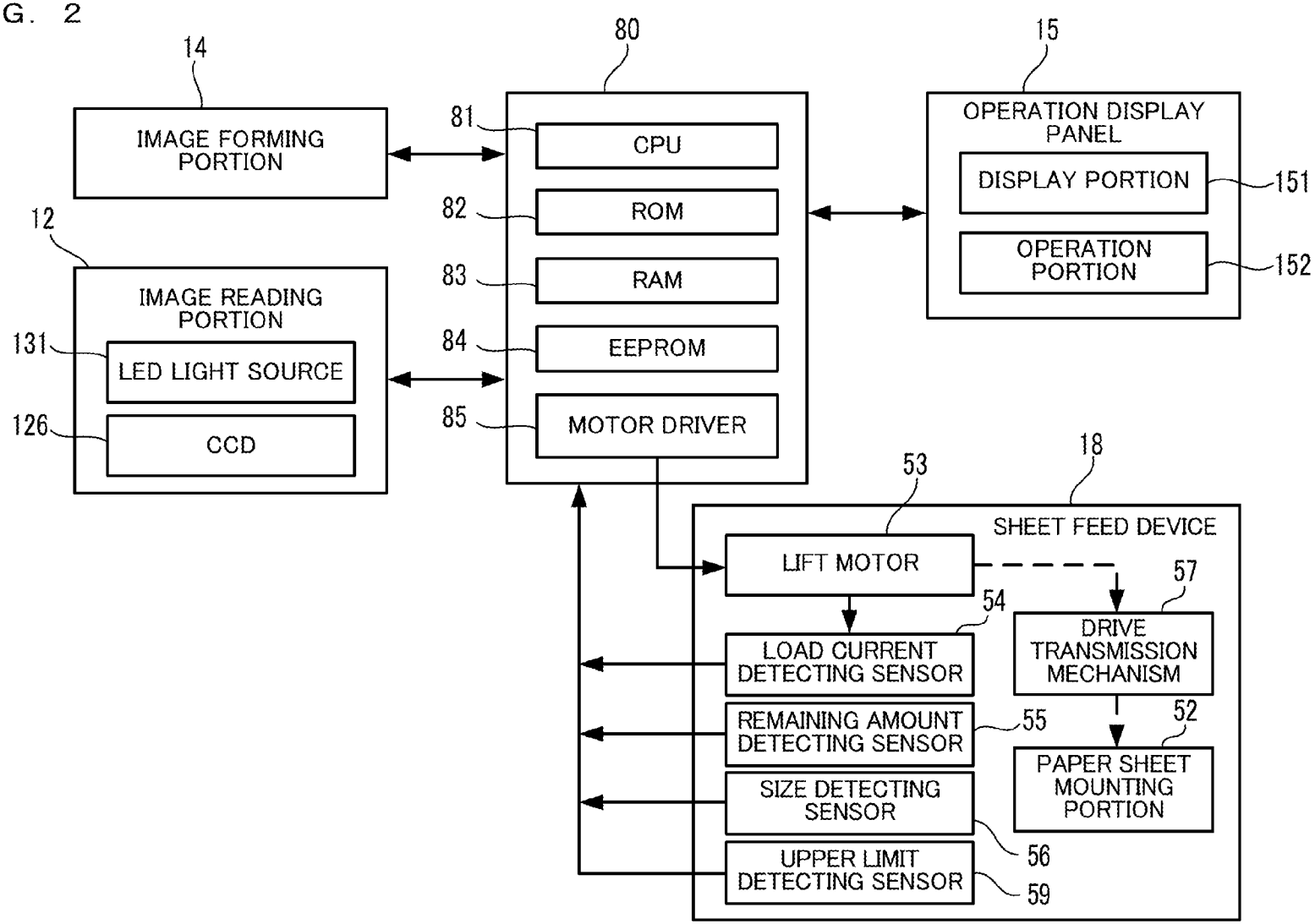
FIG. 2 is a block diagram showing the electric configuration of the image forming apparatus.

First, an image forming apparatus 10 in an embodiment of the present disclosure will be described. The image forming apparatus 10 is a multifunction peripheral having functions of a printer, a copier, and a facsimile. The image forming apparatus 10 prints an input image onto a print sheet (an example of the sheet of the present disclosure) by using a print material such as toner. As shown in FIGS. 1 and 2, the image forming apparatus 10 includes an image reading portion 12, an image forming portion 14, an operation display panel 15 (see FIG. 2), a sheet feed device 18 (an example of the sheet conveying device, the sheet stacking device of the present disclosure), and a control portion 80 (see FIG. 2). The sheet feed device 18 is configured to store a large amount of print sheets. The control portion 80 controls the operation of the image forming apparatus 10 as a whole. Note that the image forming apparatus 10 is not limited to a multifunction peripheral, but may be a specialized device such as a printer, a copier, a facsimile or the like.

As shown in FIG. 1, the image reading portion 12 is disposed at an upper part of the image forming apparatus 10. The image reading portion 12 executes an image reading process of reading image data from a document sheet. The image reading portion 12 includes a document sheet cover 20, a contact glass 121, a reading unit 122, a mirror 123, a mirror 124, an optical lens 125, and a CCD (Charge Coupled Device) 126. The reading unit 122 includes an LED light source 131 and a mirror 132, and is driven by a moving mechanism (not shown) to move in a sub scanning direction D1 (the left-right direction in FIG. 1), wherein the moving mechanism is composed of a driving motor such as a stepping motor or the like.

The image reading portion 12 reads a document sheet image based on the following procedure. First, after a document sheet is placed on the contact glass 121, the document sheet cover 20 is closed. Subsequently, upon input of an image reading instruction, the reading unit 122 is moved rightward in the sub scanning direction D1, and during the move, a line of light is irradiated consituously from the LED light source 131 toward the contact glass 121. Then light reflected on the document sheet or the rear surface of the document sheet cover 20 is guided into the CCD 126 via the mirrors 132, 123, 124 and the optical lens 125. The CCD 126 converts the received light into an electric signal based on the amount (luminance level) of the received light, and sends the electric signal to the control portion 80 (see FIG. 2) of the image forming apparatus 10. The image reading portion 12 may adopt a reading mechanism that uses a CIS (Contact Image Sensor) having a shorter focal distance than the CCD 126, instead of the reading mechanism using the CCD 126.

The document sheet cover 20 includes an ADF 21 and a document sheet stacking tray 22. The ADF 21 feeds, one by one, a plurality of document sheets stacked on the document sheet stacking tray 22 by a feeding roller (not shown). The ADF 21 moves the document sheet so as to pass an automatic document sheet reading position provided on the contact glass 121, rightward in the sub scanning direction D1. In the case where the document sheet is moved by the ADF 21, the image of the moving document sheet is read by the reading unit 122 that is disposed below the automatic document sheet reading position.

As shown in FIG. 1, the image forming portion 14 is disposed at a lower part of the image forming apparatus 10. The image forming portion 14 executes an image forming process (print process) based on the image data which has been read by the image reading portion 12, or based on a print job input from an external information processing apparatus such as a personal computer. Specifically, the image forming portion 14 performs a process of forming an image on a print sheet sent from a sheet feed tray 25 or a sheet feed device 18. The image forming portion 14 includes a photoconductor drum 31, a charging device 32, a developing device 33, a toner container 34, a transfer portion 35, an electricity removing portion 36, a fixing portion 37, three sheet feed trays 25 (25A, 25B, 25C), and a stack tray 16. It is noted that the image forming method of the image forming portion 14 is not limited to the electrophotography, but may be an inkjet recording method or other recording or printing methods.

In the sheet feed trays 25, a plurality of print sheets of specific sizes (e.g., A4-size, B4-size, A3-size) are stored. Sheet feed rollers 28 are provided in the vicinity of the sheet feed trays 25. The sheet feed rollers 28 pick up, one by one, the print sheets stored in the sheet feed trays 25, and feed the print sheet toward the transfer portion 35. In the image forming portion 14, a conveyance path 27 is provided. The conveyance path 27 extends from each of the sheet feed trays 25 to the stack tray 16 via the transfer portion 35. The print sheets, which have been fed from the sheet feed trays 25 by the sheet feed rollers 28, are conveyed in the conveyance path 27 to the transfer portion 35.

In addition, a conveyance path 29 is provided in the image forming portion 14. In the image forming portion 14, the conveyance path 29 extends from the right side (the right side in FIG. 1) of the image forming portion 14 to the transfer portion 35. The print sheet fed from the sheet feed device 18 into the image forming portion 14 is conveyed in the conveyance path 29, then conveyed in the conveyance path 27 to the transfer portion 35.

The image forming process is performed on a print sheet fed from the sheet feed trays 25 or the sheet feed device 18, based on the following procedure. First, upon input of a print job including a print instruction, the charging portion 32 charges the surface of the photoconductor drum 31 uniformly into a certain potential. Next, a laser scanner unit (LSU), which is not shown, irradiates the surface of the photoconductor drum 31 with light based on the image data included in the print job. This results in an electrostatic latent image formed on the surface of the photoconductor drum 31. Then the electrostatic latent image on the photoconductor drum 31 is developed (made visible) with toner by the developing device 33. It is noted that the toner is supplied to the developing device 33 from the toner container 34. Subsequently, the toner image formed on the photoconductor drum 31 is transferred to a paper sheet by the transfer portion 35. The print sheet is then conveyed to the fixing portion 37, and as the print sheet passes through the fixing portion 37, the toner is heated. This causes the toner image to be fused and fixed to the print sheet. Subsequently, the print sheet is discharged onto the stack tray 16 and held at a mounting surface of the stack tray 16. It is noted that the potential of the photoconductor drum 31 is removed by the electricity removing portion 36.

As shown in FIG. 2, the operation display panel 15 is connected to the control portion 80. The operation display panel 15 is disposed at an upper front part of the image forming apparatus 10. The operation display panel 15 allows operations to be input to the image forming apparatus 10, and displays the operation state of the image forming apparatus 10. The operation display panel 15 includes a display portion 151 and an operation portion 152. The display portion 151 is, for example, a liquid crystal display having a touch panel function, and displays a print setting screen and receives touch key inputs for setting and inputting the size of the print sheet or the like. The operation portion 152 is composed of, for example, a start key for inputting a print instruction, a numeric keypad for inputting the number of printing, or the like.

The user can select, from the sheet feed trays 25A, 25B, 25C and the sheet feed device 18, a print sheet to be used in the image formation by operating the operation display panel 15. In addition, the user can recognize the sizes of the print sheets stored in the sheet feed trays 25 and the sheet feed device 18, whether or not print sheets are stored therein, and the like, by referring to the print setting screen displayed on the display portion 151.

As shown in FIG. 1, the sheet feed device 18 is disposed on the right side (the right side in FIG. 1) of the image forming apparatus 10. The sheet feed device 18 stores a large amount (e.g., several thousands) of print sheets, and picks up the print sheets one by one and feeds the print sheets to the image forming portion 14. As shown in FIGS. 1 and 2, the sheet feed device 18 includes a housing 51, a paper sheet mounting portion 52 (an example of the sheet stacking portion of the present disclosure), a lift motor 53 (an example of the electric motor of the present disclosure), a load current detecting sensor 54, a remaining amount detecting sensor 55, a size detecting sensor 56, an upper limit detecting sensor 59, a drive transmission mechanism 57, and a sheet feed roller 58 (an example of the conveyance portion of the present disclosure).

Figure 3B:
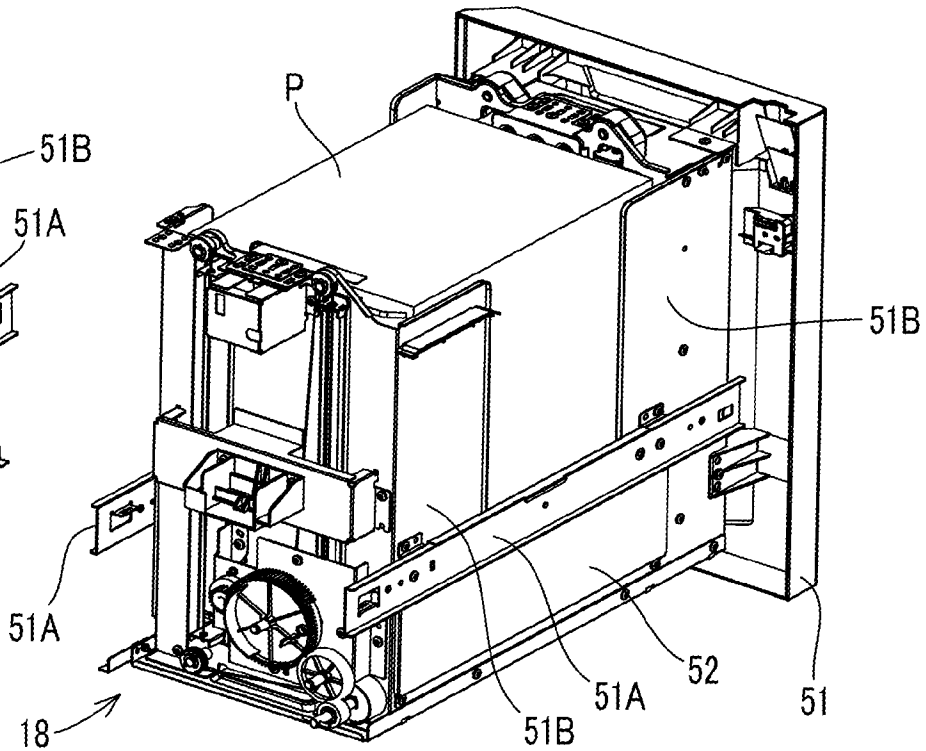
FIG. 3B is a perspective view of the sheet feed device viewed from the rear side.
Figure 3A:
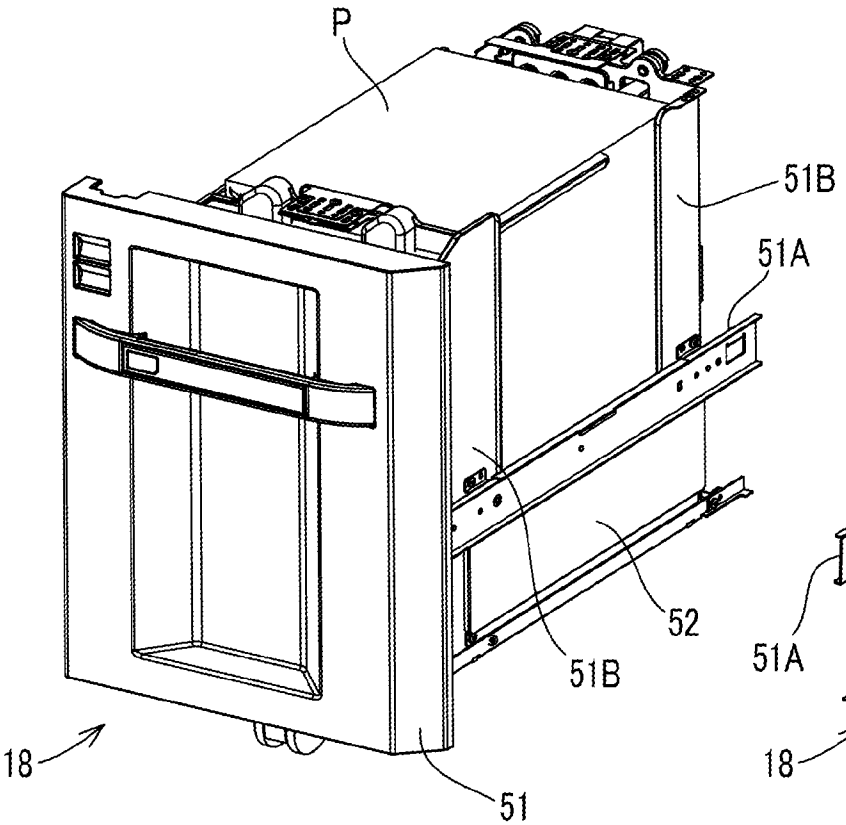
FIG. 3A is a perspective view of the sheet feed device viewed from the front side.

Inside the housing 51, an internal space for storing print sheets is provided. Specifically, as shown in FIGS. 3A and 3B, the internal space is defined by internal frames 51A constituting the housing 51 and guide plates 51B for width restriction. The paper sheet mounting portion 52 is provided in the internal space. The paper sheet mounting portion 52 is configured to stack a plurality of print sheets thereon in a layered state. FIGS. 3A and 3B show the sheet feed device 18 in which a large number of print sheets P are stacked on the paper sheet mounting portion 52. It is noted that FIGS. 3A and 3B show the sheet feed device 18 without the cover of the housing 51. The paper sheet mounting portion 52 is, for example, a member made of resin or a metal in the shape of a tray having a plane support surface. The paper sheet mounting portion 52 is supported to be movable in the up-down direction in the internal space of the housing 51. As the moving mechanism for moving the paper sheet mounting portion 52, a rail support mechanism, for example, may be adopted, wherein the rail support mechanism is engaged with rails, which are provided on the housing 51 and extend in the up-down direction, such that it can slide and move in the up-down direction. Of course, the moving mechanism is not limited to the rail support mechanism, but may be any other support mechanism.

In the internal space of the housing 51, when the paper sheet mounting portion 52 is at a predetermined lower limit position (the position indicated by the solid line in FIG. 1), the loading capacity of the paper sheet mounting portion 52 is maximum. On the other hand, when the paper sheet mounting portion 52 is at a predetermined upper limit position (the position indicated by the broken line in FIG. 1), the loading capacity of the paper sheet mounting portion 52 is minimum (zero). It is noted that FIGS. 3A and 3B show the sheet feed device 18 in the state where it is full of print sheets stacked on the paper sheet mounting portion 52 that is at the lower limit position.

The lift motor 53 is, for example, a DC motor, and outputs a driving force for moving the paper sheet mounting portion 52 in the up-down direction, and supplies the driving force to the paper sheet mounting portion 52. As shown in FIG. 2, the lift motor 53 is connected to a motor driver 85 included in the control portion 80, and is driven and controlled by the motor driver 85 and the control portion 80.

The drive transmission mechanism 57 is provided between the output shaft of the lift motor 53 and the paper sheet mounting portion 52. The drive transmission mechanism 57 transmits the rotational driving force output from the lift motor 53 to the paper sheet mounting portion 52. As the drive transmission mechanism 57, for example, a gear transmission mechanism, a belt transmission mechanism, a wire transmission mechanism, or the like may be adopted, wherein the gear transmission mechanism is composed of a shaft coupling, a gear, or the like, and the belt transmission mechanism is composed of a belt, a pulley, or the like, and the wire transmission mechanism is composed of a wire, a pulley, or the like. The electric motor of the present disclosure is not limited to the lift motor 53, but may be any type of motor or an electric motor of any driving method as far as it can supply a driving force for moving the paper sheet mounting portion 52 in the up-down direction.

As shown in FIG. 1, the sheet feed roller 58 is provided at an upper position inside the sheet feed device 18. The sheet feed roller 58 is configured to abut the uppermost surface of the print sheets stacked on the paper sheet mounting portion 52, by an elastic member (not shown) or by the self weight thereof. The state where the sheet feed roller 58 is abutting a print sheet is a sheet feedable state, and the position of the uppermost surface of the print sheets in the sheet feedable state is referred to as a sheet feed position 62 (an example of the first position of the present disclosure). When the sheet feed roller 58 is rotated while the sheet feed roller 58 is abutting the print sheet, the print sheets are picked up one by one from the paper sheet mounting portion 52 and fed into the conveyance path 29.

Figure 4:
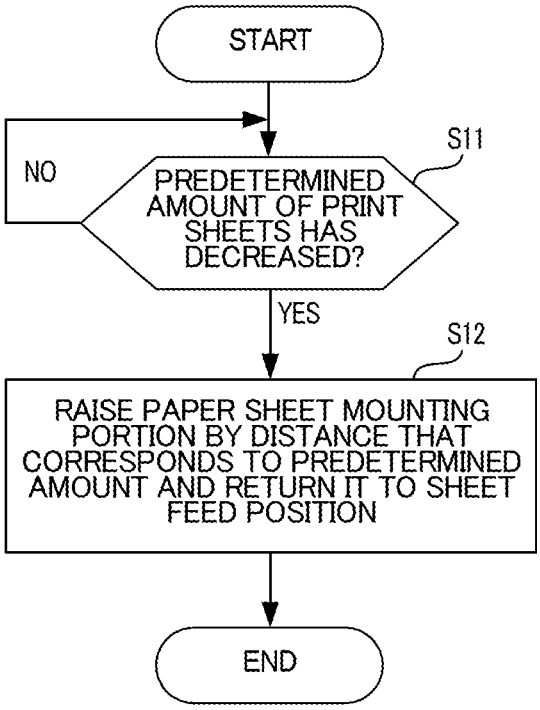
FIG. 4 is a flowchart showing an example of a raising control executed by a control portion.

Originally, as the print sheets are fed one by one from the paper sheet mounting portion 52, the print sheets decrease in amount, and the sheet feed roller 58 ceases to contact the print sheet. As a result, in the present embodiment, the control portion 80 performs the raising control when a constant amount of the print sheets has decreased. In the raising control, the control portion 80 raises the paper sheet mounting portion 52 by a distance that corresponds to the constant amount. Specifically, as shown in FIG. 4, when the control portion 80 determines that a predetermined amount of print sheets (e.g., three print sheets) has decreased (S11), the control portion 80 raises the paper sheet mounting portion 52 by a distance that corresponds to the predetermined amount (S12). The control portion 80 can detect an amount of decrease of print sheets by counting the number of paper sheets that were fed. Specifically, the thickness of each print sheet may be stored in EEPROM 84 of the control portion 80 in advance, and the control portion 80 can detect the amount of decrease of the print sheets based on the thickness of the decreased print sheets and the number of fed print sheets. It is noted that the control portion 80 executing the raising control is realized as the driving control portion of the present disclosure. Here, with a sensor provided at the sheet feed position 62 so as to detect the uppermost surface of the print sheets at the sheet feed position 62, the control portion 80 may perform a control to raise the paper sheet mounting portion 52 until the sensor detects the uppermost surface of the print sheets, thereby raising the paper sheet mounting portion 52 by a distance that corresponds to the decrease of the print sheets, and returning the paper sheet mounting portion 52 to the sheet feed position 62.

As shown in FIG. 2, the load current detecting sensor 54 is connected to the control portion 80. The load current detecting sensor 54 detects a driving current (load current) that is flowing through the lift motor 53. The load current detecting sensor 54 is specifically a current detecting circuit which is composed of a shunt resistor and an amplifier for detecting current, wherein the shunt resistor is connected in series to a power source input terminal of the lift motor 53, and the amplifier is connected to both ends of the shunt resistor. The amplifier applies differential amplification to the voltage of the current flowing through the shunt resistor, and outputs the amplification result to the control portion 80 as a voltage signal. The control portion 80 calculates the driving current flowing through the lift motor 53, based on the voltage signal input from the load current detecting sensor 54. Here, the load current detecting sensor 54 and the control portion 80 are an example of the current detecting portion of the present disclosure. It is noted that the load current detecting sensor 54 is not limited to the above-described current detecting circuit.

The upper limit detecting sensor 59 is connected to the control portion 80. The upper limit detecting sensor 59 detects that the paper sheet mounting portion 52 has reached the upper limit position (the position indicated by the broken line in FIG. 1). The upper limit detecting sensor 59 may be, for example, a reflection-type optical sensor, a sensor using a linear encoder, or the like. Alternatively, the upper limit detecting sensor 59 may be a limit switch that is activated when the paper sheet mounting portion 52 reaches the upper limit position. The upper limit detecting sensor 59 outputs a sensor signal to the control portion 80. The control portion 80 determines whether or not the paper sheet mounting portion 52 is at the upper limit position, based on the sensor signal input from the upper limit detecting sensor 59.

The remaining amount detecting sensor 55 is connected to the control portion 80. The remaining amount detecting sensor 55 detects the stack amount (stack height) of the print sheets stacked on the paper sheet mounting portion 52. The remaining amount detecting sensor 55 may be, for example, a sensor that measures the weight of the print sheets stacked on the paper sheet mounting portion 52. It can detect the stack amount from the weight and size of the print sheets. Alternatively, the stack amount may be detected based on a movement amount of the paper sheet mounting portion 52, wherein the lift motor 53 is caused to raise the paper sheet mounting portion 52 at a constant speed from the lower limit position until the upper limit detecting sensor 59 detects the paper sheet mounting portion 52, thereby obtaining the movement amount. Alternatively, the stack amount may be calculated by multiplying the print sheet thickness with the number of print sheets stacked on the paper sheet mounting portion 52. The remaining amount detecting sensor 55 outputs a sensor signal to the control portion 80. The control portion 80 calculates and detects the stack amount of the print sheets stacked on the paper sheet mounting portion 52, based on the sensor signal input from the remaining amount detecting sensor 55. Here, the remaining amount detecting sensor 55 and the control portion 80 are an example of the stack amount detecting portion of the present disclosure. In addition, the control portion 80 determines whether or not the detected stack amount of print sheets is a predetermined set sheet number P2 which is described below.

The size detecting sensor 56 is connected to the control portion 80. The size detecting sensor 56 detects the size of the print sheets stacked on the paper sheet mounting portion 52. The size detecting sensor 56 detects the size of the print sheets by, for example, the position of the guide plate 51B (see FIGS. 3A and 3B) provided inside the sheet feed device 18. The size detecting sensor 56 may be, for example, an optical sensor or a limit switch that is activated when the guide plate 51B is at a position corresponding to a size of the print sheets. The size detecting sensor 56 outputs a sensor signal to the control portion 80. The control portion 80 determines the size of the print sheets stacked on the paper sheet mounting portion 52, based on the sensor signal input from the size detecting sensor 56.

The control portion 80 totally controls the image forming apparatus 10. As shown in FIG. 2, the control portion 80 includes a CPU 81, a ROM 82, a RAM 83, an EEPROM 84, a motor driver 85, and the like. The control portion 80 is electrically connected to the electric devices that are respectively included in the image forming portion 14, image reading portion 12, operation display panel 15, and sheet feed device 18, via internal buses, signal lines, and the like. In addition, the control portion 80 performs a threshold updating process and an abnormality determining process based on the flowchart shown in FIG. 5. Here, the abnormality determining process is a process for detecting an abnormality during raising and lowering the paper sheet mounting portion 52 and an abnormality in the lift motor 53. The threshold updating process is a process for updating an overload threshold P1 (an example of the threshold of the present disclosure) that is used in the abnormality determining process to determine whether or not an overload has occurred.

The ROM 82 stores various types of control programs. For example, the ROM 82 stores control programs and data for detecting or determining the current value of the lift motor 53, the stack amount of print sheets, the paper sheet size, the upper limit position of the paper sheet mounting portion 52, and the like, based on the sensor signals received from the load current detecting sensor 54, remaining amount detecting sensor 55, size detecting sensor 56, upper limit detecting sensor 59, and the like. In addition, the ROM 82 stores control programs for performing the threshold updating process and the abnormality determining process. As these control programs are executed by the CPU 81, the threshold updating process and the abnormality determining process are performed, and the operation of the image forming apparatus 10 is controlled. It is noted that the control portion 80 may be formed from an electronic circuit such as an integrated circuit (ASIC, DSP).

The RAM 83 is used as a work area in which data or the like is expanded during execution of a program by the CPU 81. The RAM 83 is also used as an area in which data is temporarily stored. The EEPROM 84 stores thresholds that are used in determining steps in the threshold updating process and the abnormality determining process. Specifically, the thresholds are an overload threshold P1 and a set sheet number P2, wherein the overload threshold P1 is used to determine whether or not an excessive load (overload) is applied to the lift motor 53, and the set sheet number P2 (an example of the set amount of the present disclosure) is used to determine whether or not to update the overload threshold P1. The set sheet number P2 is, for example, any of the numbers of stacked sheets corresponding to 100%, 50%, and 30% of the maximum stack amount of the print sheets stacked on the paper sheet mounting portion 52.

Figure 5:
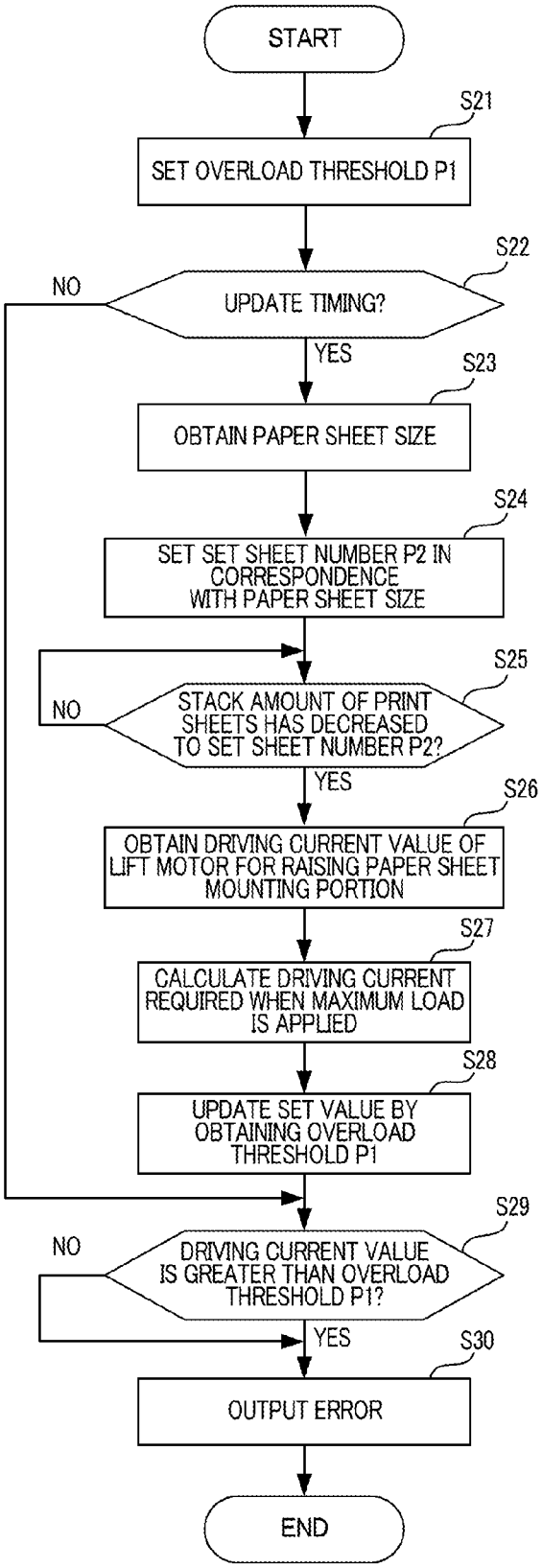
FIG. 5 is a flowchart showing an example of a threshold updating process and an abnormality determining process executed by the control portion.

The following describes an example of the threshold updating process and the abnormality determining process executed by the control portion 80, with reference to the flowchart shown in FIG. 5. Here, S21, S22, . . . in FIG. 5 represent the processing procedures (steps). It is noted that when these processes are executed by the control portion 80 based on the processing procedures, the control portion 80 is realized as the current detecting portion, abnormality determining portion, updating portion, and stack amount detecting portion of the present disclosure.

(Threshold Updating Process)

The threshold updating process is shown by the procedures in steps S21-S28 of FIG. 5.

First, the control portion 80 reads the overload threshold P1 from the EEPROM 84, and stores it in the set memory area in the RAM 83 (step S21). Subsequently, the control portion 80 determines whether or not it is an update timing to update the overload threshold P1 (step S22). The update timing is, for example, any of the times when the image forming apparatus 10 is powered on, when a print job is input into the image forming apparatus 10, and when print sheets are supplemented to the image forming apparatus 10. The control portion 80 determines whether or not it is an update timing, based on the presence/absence of the start signal at the power-on, the presence/absence of reception of the print job, various types of sensor signals provided in the sheet feed device 18, and the like. It is noted that, in the following, the update timing is, as an example, the time when print sheets are supplemented to the image forming apparatus 10. When it is determined in step S22 that it is the update timing, the control proceeds to step S23, and when it is determined that it is not the update timing, the control proceeds to step S29.

In step S23, the control portion 80 obtains the size of the print sheets stored in the sheet feed device 18. Specifically, as described above, the control portion 80 detects the size of the print sheets that are actually stored, from the sensor signal input from the size detecting sensor 56. Subsequently, in step S24, the control portion 80 calculates the set sheet number P2 in correspondence with the paper sheet size obtained in step S23, and stores the calculated set sheet number P2 in the set memory area.

Here, the set sheet number P2 is a threshold that is used to determine whether or not the stack amount of the print sheets stacked on the paper sheet mounting portion 52 indicates a predetermined constant weight. In other words, the set sheet number P2 is an index indicating, for any paper sheet size, that a constant load is applied to the lift motor 53 by the stacked print sheets. For example, suppose that print sheets of A4 size and S3 size, both having the same paper quality, are used, and the set sheet number P2 is "500 print sheets" when print sheets of A4 size are stacked on the paper sheet mounting portion 52. In that case, since the A3 size is double the A4 size, the set sheet number P2 is "250 print sheets" when print sheets of A3 size are stacked on the paper sheet mounting portion 52. Of course, by taking the print sheet thickness into account, the set sheet number P2 may be set to indicate the same weight.

In the next step S25, the control portion 80 determines whether or not the stack amount of the print sheets on the paper sheet mounting portion 52 has decreased to the set sheet number P2 due to execution of the print process consuming the print sheets. Specifically, the control portion 80 detects the stack amount of the print sheets actually stored, from the sensor signal input from the remaining amount detecting sensor 55. Step S25 is repeatedly executed until it is determined that the stack amount of the print sheets has decreased to the set sheet number P2.

When it is determined in step S25 that the stack amount of the print sheets has decreased to the set sheet number P2, the control proceeds to step S26, in which the control portion 80 obtains the driving current value of the lift motor 53. Specifically, as described above, the control portion 80 calculates the driving current that flows through the lift motor 53, based on the voltage signal input from the load current detecting sensor 54. At this time, to obtain a driving current that flows through the lift motor 53 when a load is applied to the lift motor 53, the control portion 80 calculates the driving current that flows through the lift motor 53, based on a voltage signal that was output from the load current detecting sensor 54 while the paper sheet mounting portion 52 was being moved upward by the raising control. The calculated value of the driving current is temporarily stored in the RAM 83.

In the next step S27, the control portion 80 calculates the driving current that is required when the maximum load is applied (hereinafter, the driving current is referred to as "maximum load current"), based on the driving current obtained in step S26. Here, the maximum load is the largest load applied by the paper sheet mounting portion 52 to the lift motor 53 during the normal operation. Specifically, the maximum load is a load that is applied when print sheets of the maximum size (e.g., A3 size) among those that can be stacked on the paper sheet mounting portion 52, are fully stacked on the paper sheet mounting portion 52. Since the maximum allowable stack amount of the paper sheet mounting portion 52 has already been determined, in this step S27, the maximum load current is calculated by multiplying the driving current calculated in step S26 with a ratio that is obtained from a ratio of the set sheet number P2 to the maximum allowable stack amount, and from the size of the print sheets stacked on the paper sheet mounting portion 52.

In the next step S28, the control portion 80 updates the overload threshold P1 to a value that corresponds to the driving current at the time when the paper sheet mounting portion 52 with the set sheet number P2 of print sheets stacked thereon is being moved by the lift motor 53. Specifically, the control portion 80 updates the value of the overload threshold P1 in the set memory area of the RAM 83, by calculating a new overload threshold P1 by multiplying a predetermined safe ratio (e.g., 120%) with the maximum load current calculated in step S27, and storing the calculated new overload threshold P1 in the set memory area of the RAM 83. With this configuration, the current value of the lift motor 53 is always detected under the same condition, and the value of the overload threshold P1 is updated in correspondence with the detected current value.

(Abnormality Determining Process)

The abnormality determining process is shown by the procedures in steps S29-S30 in FIG. 5.

First, the control portion 80 always monitors the driving current of the lift motor 53 based on the voltage signal input from the load current detecting sensor 54, and determines whether or not the driving current of the lift motor 53 is greater than the overload threshold P1 stored in the set memory area of the RAM 83. When the threshold updating process has been performed, the driving current is compared with the updated and newly stored overload threshold P1, and when the threshold updating process has not been performed, the driving current is compared with the overload threshold P1 before update. Here, when it is determined that the driving current of the lift motor 53 is greater than the overload threshold P1, the control portion 80 determines that an excessive load greater than the maximum load is applied to the lift motor 53 due to an abnormal operation of the paper sheet mounting portion 52 or the like. The control portion 80 then outputs an error indicating the abnormality to the operation display panel 15 or the like.

Meanwhile, in general, when an electric motor such as the lift motor 53 is used for a long period, it is deteriorated and its output efficiency is decreased due to abrasion of bearings, attenuation of permanent magnets, damage of coils, deterioration of the housing, brush abrasion, and the like. That is, in the case where the load for raising the paper sheet mounting portion 52 does not change, but the output efficiency of the electric motor is decreased, the driving current required by the electric motor for the load increases. As a result, conventionally, the overload current value is set to a value (for example, a value obtained by multiplying a predetermined safe ratio with the driving current that corresponds to the maximum load in the deteriorated state) that corresponds to the driving current that will be required when the electric motor is deteriorated in future.

Figure 7:
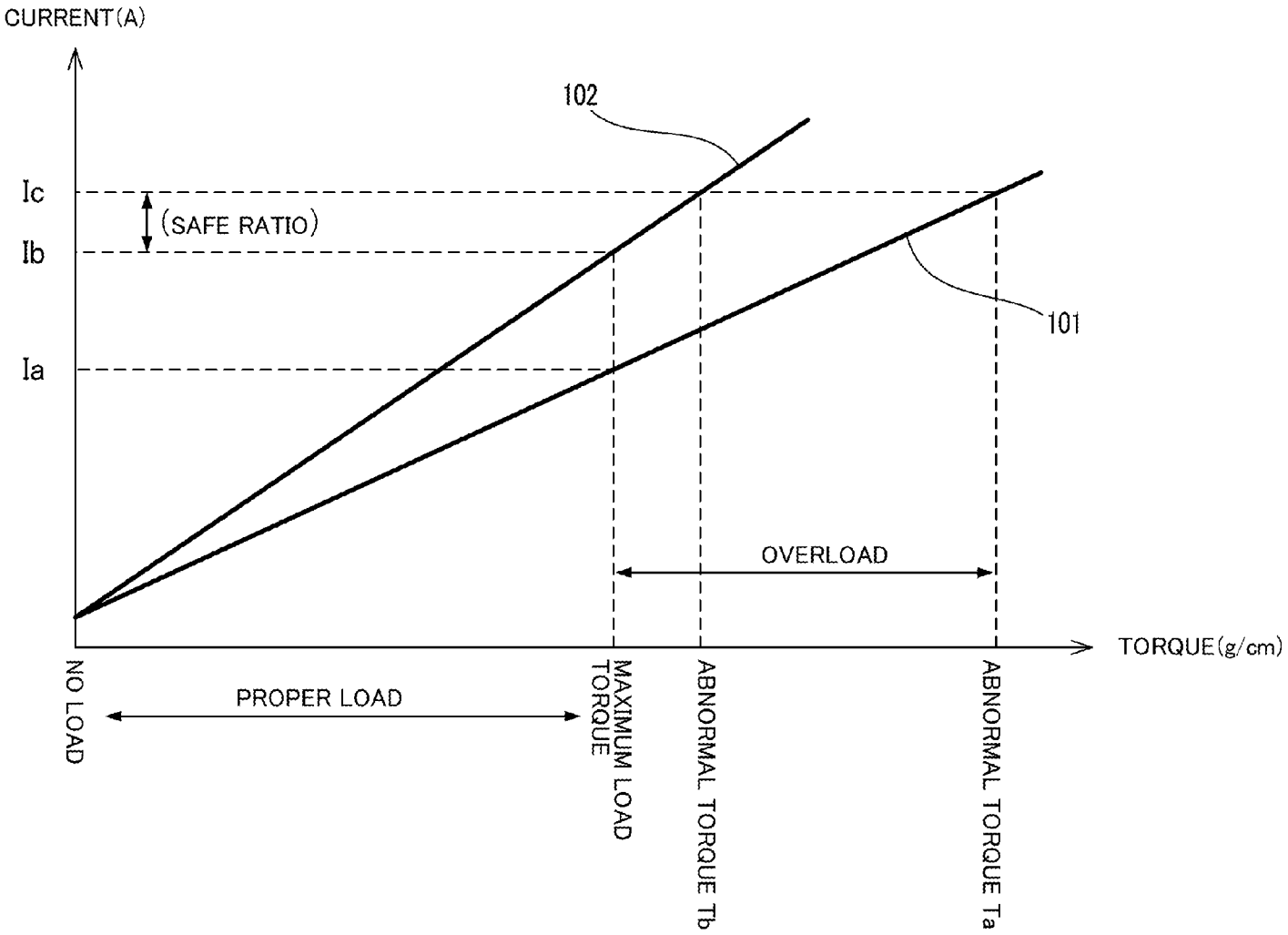
FIG. 7 is a graph representing a torque-current characteristic showing relationship between driving current and torque of an electric motor.

When an abnormality detection is performed by using the overload current value that is set as described above, the abnormal torque of the electric motor in the abnormality detection is significantly different between before and after the deterioration of the electric motor. For example, in the torque-current characteristic graph shown FIG. 7, the torque-current characteristic of the electric motor before the deterioration is represented by a straight line 101, and the torque-current characteristic of the electric motor after the deterioration is represented by a straight line 102. As easily understood from the straight lines 101 and 102, if an overload current value Ic (a value obtained by multiplying a predetermined safe ratio with a driving current Ib that corresponds to the maximum load) is set with reference to the straight line 102, an abnormal torque Ta, an abnormal torque in the case where an abnormality is determined when a not-deteriorated electric motor in the initial period is operating, would be extremely large. In that case, an excessive load (overload) is applied to the peripheral mechanisms (bearings, shaft coupling, gear, pulley, wire, belt, housing and the like) of the electric motor. As a result, these peripheral mechanisms are designed to have a configuration that withstands the abnormal torque Ta in the case where the electric motor before deterioration is operated with the overload current value Ic.

If a reinforcing member is provided or a member having a high strength is adopted so that the peripheral mechanisms of the electric motor have a configuration that withstands a high abnormal torque Ta, the device becomes large-scale and the parts increase in number. In addition, it leads to cost increase. On the other hand, if the overload current value Ic is determined based on a small safe ratio, the abnormal torque Ta becomes small as well. However, in that case, there is almost no torque difference between the abnormal torque Tb of the deteriorated electric motor and the maximum load torque, and depending on the level of the deterioration, the abnormal torque Tb may become smaller than the maximum load torque, and the abnormality determination may be performed erroneously.

On the other hand, according to the image forming apparatus 10 of the present embodiment, after print sheets are supplemented to the paper sheet mounting portion 52, each time the stack amount of print sheets decreases to the set sheet number P2, the overload threshold P1 is updated to a value that corresponds to the driving current of the lift motor 53 at that time. As a result, there is no need to set the overload threshold P1 by taking account of the state where the lift motor 53 is deteriorated due to a long-term use. Accordingly, before the lift motor 53 is deteriorated, the abnormality determination is performed by using a value of the overload threshold P1 that is lower than a value of the overload threshold P1 that will be applied when the lift motor 53 is deteriorated in future. As a result, an appropriate abnormality determination can be performed without giving an excessive strength to the drive transmission mechanism 57 and the housing 51 that are peripheral mechanisms of the lift motor 53. This enables the drive transmission mechanism 57 and the housing 51, as well as the bearings, shaft coupling, support mechanism and the like of the lift motor 53, to be made small.

In the above-described embodiment, when it is determined in step S25 of FIG. 5 that the stack amount of the print sheets has decreased to the set sheet number P2, processes of steps S26 through S28 are executed. However, the present disclosure is not limited to this. For example, in step S25 of FIG. 5, it may be determined that the stack amount of the print sheets has decreased to the set sheet number P2 when it is detected that the paper sheet mounting portion 52 has reached a predetermined position between the lower limit position and the upper limit position.

The above embodiment describes an example where a large number of print sheets P are stacked on the paper sheet mounting portion 52. However, the document sheet stacking tray 22 provided in the ADF 21 and the sheet feed tray 25 provided in the image forming portion 14 can each have a large number of document sheets stacked thereon, and when these trays can be moved in the up-down direction by motors or the like, the present disclosure is applicable to their configurations as well. In that case, the document sheet stacking tray 22 and the sheet feed tray 25 correspond to the sheet stacking portion of the present disclosure.

Figure 6:
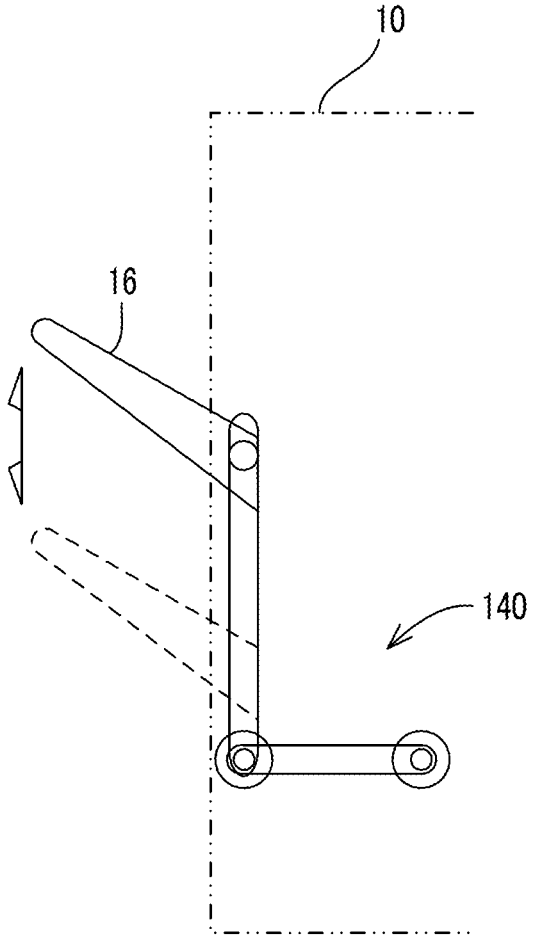
FIG. 6 is a diagram showing the configuration of a moving mechanism for moving a stack tray.

Furthermore, the present disclosure is applicable to a configuration where, as shown in FIG. 6, the stack tray 16 (an example of the sheet stacking portion of the present disclosure) of the image forming apparatus 10 is supported to be movable in the up-down direction. Here, FIG. 6 is a schematic diagram showing an outlined configuration of the moving mechanism for moving the stack tray 16. The stack tray 16 is moved in the up-down direction by a driving force obtained from a motor (not shown) via a drive transmission mechanism 140 such as a pulley or a belt. This movement is performed when the motor is driven and controlled by the control portion 80. When print sheets are discharged onto the stack tray 16 and a constant amount of print sheets is stacked thereon, the stack tray 16 is moved downward. After this operation is repeated certain times, a large number of print sheets are stacked on the stack tray 16. The present disclosure can be applied to this configuration to determine whether or not the stack tray 16 is in an abnormal state.

It is noted that the present disclosure may be not only what is recognized as an image forming apparatus, but also a sheet conveying device for conveying print sheets from stacked print sheets, or a sheet stacking device for storing a large amount of print sheets.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet stacking device comprising:

a sheet stacking portion configured to stack a plurality of sheets thereon, the sheet stacking portion being supported to be movable in an up-down direction;

an electric motor configured to output, to the sheet stacking portion, a driving force for moving the sheet stacking portion in the up-down direction;

a current detecting portion configured to detect a current value of the electric motor;

an abnormality determining portion configured to determine that the sheet stacking portion is in an abnormal state when the current value detected by the current detecting portion is greater than a predetermined threshold; and an updating portion configured to update the predetermined threshold based on a current value that was detected by the current detecting portion while the sheet stacking portion with a predetermined set amount of sheets stacked thereon was being moved by the driving force received from the electric motor.

2. The sheet stacking device according to claim 1, further comprising a stack amount detecting portion configured to detect whether or not a stack amount of the sheets stacked on the sheet stacking portion is the set amount, wherein when the stack amount detecting portion detects that the stack amount of the sheets is the set amount, the updating portion updates the predetermined threshold based on the current value detected by the current detecting portion.

3. The sheet stacking device according to claim 1, wherein the updating portion calculates, based on the current value detected by the current detecting portion, a current value of the electric motor for a maximum load, obtains a value by multiplying a predetermined safe ratio with the calculated current value, and updates the predetermined threshold to the obtained value.

4. The sheet stacking device according to claim 1, further comprising a driving control portion configured to, when a stack amount of the sheets stacked on the sheet stacking portion has decreased, control the electric motor to move the sheet stacking portion upward until an uppermost surface of the plurality of sheets stacked on the sheet stacking portion reaches a predetermined first position, wherein the updating portion updates the predetermined threshold based on the current value that was detected by the current detecting portion while the sheet stacking portion was being moved upward by the driving control portion.

5. A sheet conveying device comprising:

the sheet stacking device according to claim 1; and a conveying portion configured to pick up sheets from the sheet stacking device and convey the sheets one by one.

6. An image forming apparatus comprising the sheet stacking device according to claim 1.

* * * * *